United States Patent [19]

Wrulich et al.

[11] Patent Number: 4,721,340

[45] Date of Patent: Jan. 26, 1988

[54] PROCESS FOR CONTROLLING THE MOVEMENT OF AN UNIVERSALLY SWIVELLABLE CUTTING ARM AS WELL AS CONTROL DEVICE FOR PERFORMING THIS PROCESS

[75] Inventors: Herwig Wrulich; Alfred Zitz; Otto Schetina, all of Zeltweg, Austria

[73] Assignee: Voest-Alpine Aktiengesellschaft, Austria

[21] Appl. No.: 909,887

[22] Filed: Sep. 22, 1986

[30] Foreign Application Priority Data

Oct. 14, 1985 [AT] Austria ..... 2973/85

[51] Int. Cl.[4] ..... E21C 25/06; E21C 35/24

[52] U.S. Cl. ..... 299/1; 299/75

[58] Field of Search ..... 299/1, 75

[56] References Cited

U.S. PATENT DOCUMENTS

| | | | |
|---|---|---|---|
| 4,023,861 | 5/1977 | Schnell | 299/1 |
| 4,027,210 | 5/1977 | Weber | 299/1 X |
| 4,033,626 | 7/1977 | Dinkelbach | 299/1 |
| 4,261,617 | 4/1981 | Droscher et al. | 299/1 |
| 4,285,546 | 8/1981 | Etherington | 299/1 |
| 4,343,512 | 8/1982 | Heitkamp et al. | 299/75 X |
| 4,367,898 | 1/1983 | Oven et al. | 299/1 |
| 4,412,700 | 11/1983 | Zitz et al. | 299/1 |
| 4,588,230 | 5/1986 | Schupphaus | 299/1 |

*Primary Examiner*—George A. Suchfield

*Attorney, Agent, or Firm*—Cushman, Darby & Cushman

[57] ABSTRACT

A process for controlling the movement of a universally swivellable cutting arm of a partial cut, cutting machine, comprising a first hydraulic drive for lifting and lowering the cutting arm, and a second hydraulic drive for swivelling the cutting arm transversely to the lifting and lowering direction, consistent at the end of the advancing movement of the cutting head in one direction or both directions. The respective other drive is, in particular, when having attained the nominal profile, simultaneously supplied with pressurized fluid. Conveniently, a predetermined volumetric amount of pressurized fluid is pressed into the other drive on occasion of a reversal of the cutting direction. A control device for performing this process includes a stepped piston, which can be subjected to the action of pressurized fluid at times via a centrally arranged working chamber and at times via a separate annular chamber having a greater radius, and comprises controllable valves which selectively connect the centrally arranged working chamber of the stepped piston at that side of the stepped piston which is located opposite the inlet for pressurized fluid with a drive of the cutting arm acting in a direction being different from the direction of action of the other drive, being simultaneously supplied with pressurized fluid, for the cutting arm.

8 Claims, 4 Drawing Figures

PROCESS FOR CONTROLLING THE MOVEMENT OF AN UNIVERSALLY SWIVELLABLE CUTTING ARM AS WELL AS CONTROL DEVICE FOR PERFORMING THIS PROCESS

BACKGROUND OF THE INVENTION

1. Field of the Invention

The invention refers to a process for controlling the movement of an universally swivellable cutting arm of a partial cut cutting machine comprising a first hydraulic drive for lifting and lowering the cutting arm and a second hydraulic drive for swivelling the cutting arm transversely relative to the lifting and lowering direction as well as to a device for performing this process.

2. Description of the Prior Art

Partial cut cutting machines equipped with a universally swivellable cutting arm frequently comprise hydraulic cylinder-piston-aggregates for lifting and lowering the cutting arm in substantial vertical direction as well as a swivel drive which may, for example, be obtained by the engagement of a hydraulically actuated toothed rack in a toothed wheel of a traversing gear. In this case, swivelling of the cutting arm is, as a rule, effected about an axis extending essentially in normal direction relative to the chassis and on account of this traversing gear also the hydraulic cylinder-piston-aggregates for lifting and lowering the cutting arm are swivelled about this axis substantially extending in vertical direction. The cutting arm can thus be lifted or lowered in any horizontally swivelled position.

For cutting profiles with partial cut cutting machines having provided on the free end of the cutting arm cutting heads rotatably supported for rotation around an axis transversely extending relative to the longitudinal axis of the cutting arm, the advancing direction is most frequently selected in direction of the axis of rotation of the cutting head. After having reached the nominal profile, the cutting head is lifted or lowered for the so-called preselected depth of cut, whereupon the advancing movement is effected in the opposite direction and again in an essentially horizontal direction. On account of the construction of such cutting machines, there remains a rib of rock between both cutting heads arranged on the free end of the cutting arm when lifting or lowering the cutting arm for obtaining the new preselected depth of cut. This rib must subsequently be broken away when swivelling the cutting arm in a substantially horizontal direction. In dependence on the properties of the rock and on the construction of the machine, this rib may be too great for being easily broken away by swivelling the cutting arm. In these cases, swiyelling of the cutting arm in its new position is only possible with difficulties, and laboursome manual operations are required for crushing this rib to be then in the position to continue cutting work in the opposite direction.

SUMMARY OF THE INVENTION

The invention now aims at providing a process of the initially mentioned type, in which reversal of the cutting direction is, in particular after having reached the nominal profile, reliably and in a simple manner possible without running the risk that the swivelling movement of the cutting machine is blocked by a remaining rib. For solving this task, the process according to the invention essentially consists in that at the end of the advancing movement of the cutting arm effected in one direction of both directions, the respective second drive means is, on occasion of reversal of the cutting direction and in particular when having attained the nominal profile, simultaneously supplied with pressurized fluid. On account of the fact that on occasion of reversal of the cutting direction or, respectively, the advancing movement both hydraulic drive means are simultaneously energized by pressurized fluid, cutting work is effected in diagonal direction, so that the risk of a remaining rib can be eliminated. The inclination of the diagonally extending partial path of the cutting arm movement depends, in this case and with the amount of pressurized fluid being preselected, only on the advancing speed in the other direction, noting that a flatter inclination can be obtained when rapidly swivelling the cutting arm in the opposite direction and that a correspondingly steeper inclination of the diagonal partial path of the cutting arm movement can be obtained in case of a slower swivelling movement. The preselected depth of cut is, in this case, essentially dependent on the volumetric amount of pressurized fluid supplied to the second hydraulic drive means and for this reason the procedure is advantageously such that on occasion of reversal of the cutting direction a predetermined volumetric amount of pressurized fluid is pressed into the second drive means.

Cutting machines of the initially mentioned type comprise, as a rule, a common source of pressurized fluids for the swivel drive and for the drive means for moving the cutting arm in essentially vertical direction. For reliably providing the possibility to perform the process according to the invention without using an additional drive means and to press a predetermined volumetric amount of pressurized fluid into the respective other drive means, the device according to the invention is essentially characterized in that there is provided a stepped piston, which can be actuated with pressurized fluid supplied to a centrally arranged working chamber and supplied to a separate annular chamber of greater radius, respectively, and in that there are arranged controllable valves which selectively connect the centrally arranged working chamber of the stepped piston at that side of the stepped piston which is located opposite the inlet for pressurized fluid with one drive means of the cutting arm acting in a direction being different from the direction of action of the other drive means, being simultaneously supplied with pressurized fluid, for the cutting arm. On account of a stepped piston being provided in an device according to the invention, an embodiment can be realized, in which the pressurized fluid actuating one drive means becomes effective at one side of the stepped piston on a greater cross-sectional area than would correspond to the centrally arranged working chamber of the stepped piston at the other side, and the stepped piston can, on account of the effective differences of cross section be moved in one direction, noting that pressurized fluid is pressed out of the centrally arranged working chamber having the smaller cross-sectional area and being provided at the opposite side of the stepped piston into the respective other drive means. The volumetric amount of this expelled pressurized fluid can, in a particularly simple manner, be predetermined by limiting, advantageously in an adjustable manner, the stroke of the stepped piston. By means of such an apparatus, the operation can be automated to a high degree such that on occasion of each reversal of the cutting direction effected after having attained the nominal profile there is first cut a short partial area in diagonal direction and subsequently cutting work is effected in the usually selected advancing direction. The usually selected advancing direction is, as already initially mentioned, that direction which results by swivelling the cutting arm around an essentially vertical axis, and the cutting heads are moved in axial direction of their axes of rotation.

Further automation can be achieved if there is provided a source of control pressure , which source can be connected via a preselection means with a control slide piston for controlling the direction of movement of the cylinder-piston-aggregate receiving the volume of pressurized fluid expelled out of the working chamber of the stepped piston and which source can further be connected with controllably openable check valves provided in branch conduits of the supply conduit and discharge conduit of the other hydraulic drive means of the cutting arm. By means of such an additional source of control pressure and by means of the preselection means, there can, on occasion of reversal of the cutting direction, be preselected at first the direction of the preselected depth of cut for the following working step, for example in upward direction or in downward diredtion. Such a source of control pressure further provides the possibility to reliably control simultaneously the necessary valve control of the controllable openable check valves. The differential piston or stepped piston, respectively, must be subjected to the action of pressurized fluid only on occasion of the intended reversal of the cutting direction, so that during normal operation, i.e. when actuating one of both drive means for advancing the cutting head or cutting heads, the working chambers of the stepped piston may be kept closed by check valves. It is only in case of a reversal of the cutting direction that such check valves, which are directly connected to the pressure conduit leading to the just actuated advancing drive means and, respectively, are connected to the return conduit, must be steered open, whereupon subsequently a predetermined volumetric amount of pressurized fluid is expelled to the respective other side of the stepped piston and into the drive means providing preselection of the depth of cut.

In this case, the arrangement is advantageously such that the branch conduits of the supply conduit and the discharge conduit of the other hydraulic drive means are connected with the respective annular chambers at both sides of the stepped piston and that conduits are branched off these annular chambers and are connected with the respective centrally arranged working chambers at the same side of the stepped piston via check valves closing in direction to these annular chambers. With such an arrangement of the valves it is made sure that, when pressurizing the annular chamber at one side of the stepped piston, the centrally arranged working chamber at the same side of the stepped piston can simultaneously be pressurized, so that the desired difference of the surfaces of attack is reliably established for expelling a predetermined volumetric amount of pressurized fluid out of the opposite central working chamber. If the cross sectional area of the annular chamber is made sufficiently great, such connection of the centrally arranged working chamber of the same side with the respective annular chamber via the check valve can be omitted. Simultaneously with the shifting movement of the stepped piston in one direction, the centrally arranged working chamber at the side located opposite the pressurized side shall simultaneously be opened in direction to the drive means for the cutting arm, for which purpose there are advantageously provided controllably openable check valves, opening to the centrally arranged working chambers of the stepped piston, in conduits which connect the centrally arranged working chambers of the stepped piston via the control piston with the working chambers of the cylinder-piston-aggregate provided for driving the cutting arm. Such check valves can be brought into open position in principle equally by the source of control pressure via the preselection means. However, the arrangement can for this purpose be such that the control conduits for the check valves of a centrally arranged working chamber are connected with the branch conduit leading to the opposite annular chamber or centrally arranged working chamber, respectively.

In consideration of the preferred mode of operation according to which cutting operation or advance movement is effected in axial direction of the rotating cutting heads, the drive means being subjected to the action of pressurized fluid is, in normal operating conditions, the drive means of the horizontal swivelling drive. In these cases, the arrangement is, according to the invention, such that the branch conduits connected to the annular chambers of the stepped piston are connected with the conduits leading to the horizontal swivel drive means of the cutting arm.

BRIEF DESCRIPTION OF THE DRAWING

In the following, the invention is further explained with reference to an embodiment schematically shown in the drawing, in which.

DETAILED DESCRIPTION OF THE PREFERRED EMBODIMENT

Figure 1:
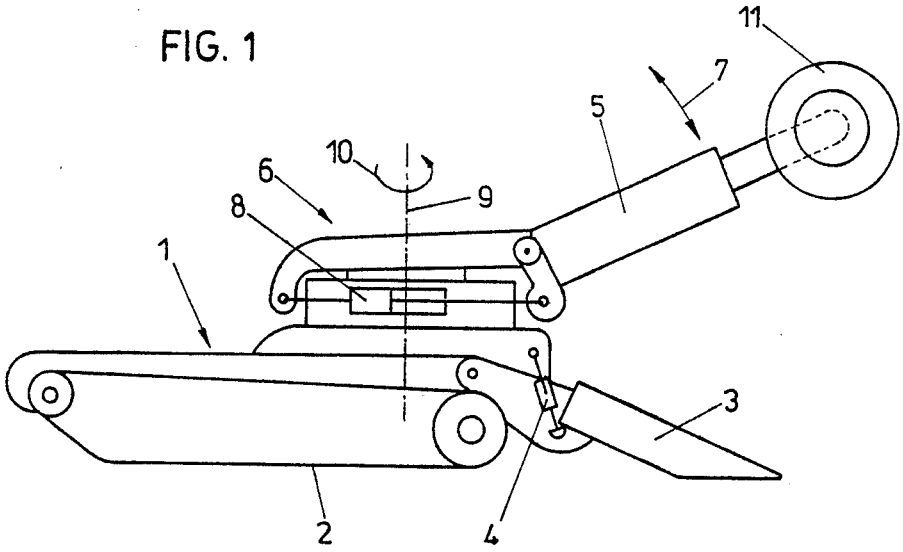
FIG. 1 shows a schematic side elevation of a cutting machine.

In FIG. 1, reference numeral 1 designates a cutting machine, the caterpillar chassis 2 of which can travel on the floor. The cutting machine has, beside a usually provided loading ramp 3 being arranged for being lifted and lowered by an hydraulic cylinder-piston-aggregate 4, a cutting arm 5. The cutting arm 5 is swivellable in direction of the twin-arrow 7 in height direction on a traversing gear 6, for which purpose there are provided hydraulic cylinder-piston-aggregates 8. Furthermore, provision is made for swivelling movement around a substantially vertical axis 9 in direction of the twin arrow 10. The swivel drive means for effecting this horizontal swivelling movement is shown in FIG. 2.

The free end of the cutting arm 5 carries rotatably supported cutting heads 11, noting that a rotation drive means for these cutting heads 11 is provided within the interior of the cutting arm 5.

Figure 2:
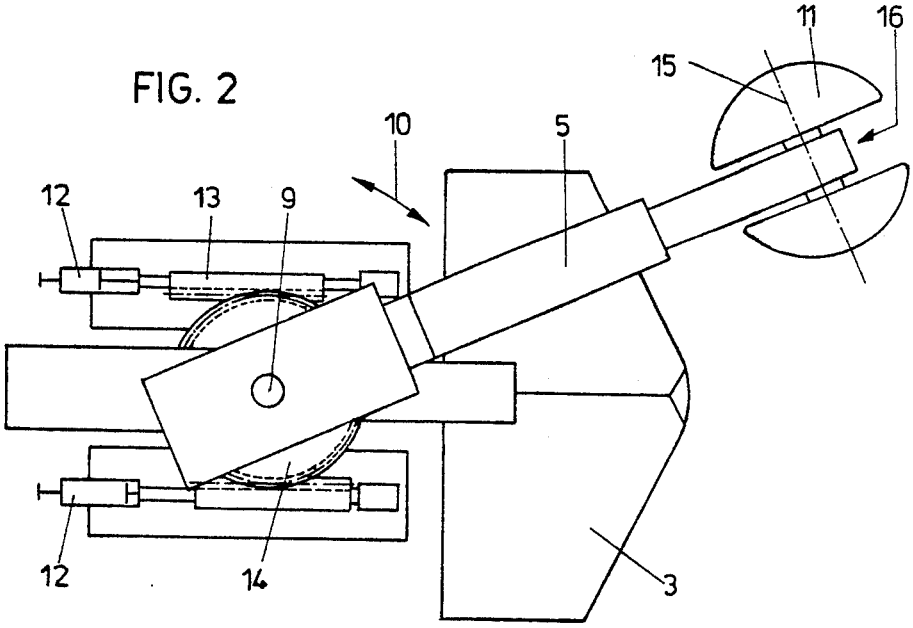
FIG. 2 shows a top plan view of the cutting machine according to FIG. 1 with non-important details being omitted.

As can be derived from FIG. 2, swivelling movement in direction of the twin arrow 10, i.e. in a substantially horizontal plane, is effected by hydraulic cylinder-piston-aggregates 12, actuating toothed racks 13 being in meshing engagement with a toothed wheel 14 of the traversing gear 6. As can be further taken from the representation according to FIG. 2, there exists an interstice 16 between the cutting heads 11 which are rotatably supported for rotation around an axis 15 intersecting the longitudinal axis of the cutting arm in essentially a right angle. Advancing movement of such cutting machines during cutting work is, as a rule, effected by operating the traversing gear 6 and thus in direction of the axes 15 of rotation. Preselection of the depth of cut is effected by lifting or lowering the cutting arm 5 in the sense of the twin arrow 7 in FIG. 1, noting that this preselection of the depth of cut can, in particular in connection with soft material such as coal, kalium salts or the like, not always be attained on account of the housing of the gearing and on account of the interstice 16. In any case, there remains, however, when lifting or lowering the cutting arm 5 in direction of the twin arrow 7, within the rock a rib corresponding to the interstice 16, which rib must be broken away on occasion of the subsequent advancing movement effected by a swivelling movement in direction of the twin arrow 10 or, respectively, moving the cutting heads 11 in direction of their axis 15 of rotation. This is, in particular in case of hard rock, not easily possible.

Figure 3:
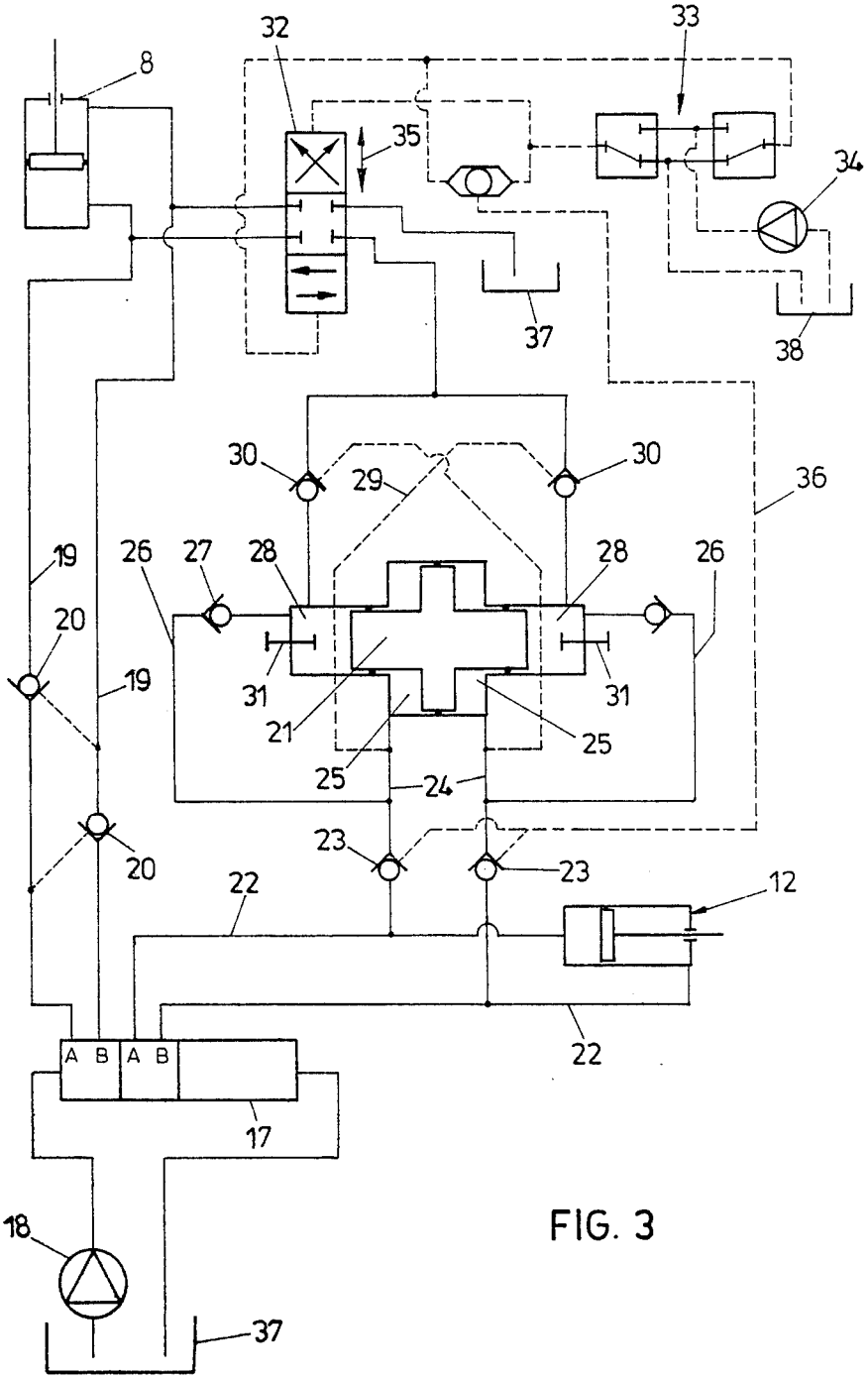
FIG. 3 shows a schematic circuitry of the inventive device for controlling the movement of the cutting arm and FIG. 4 shows the path of movement of the cutting arm in a projection onto the drift face.

The circuitry according to FIG. 3 is now provided for preselecting the depth of cut when changing the direction of cutting work such that no rib remains between the cutting heads 11. The hydraulic drive means for lifting and lowering the cutting arm is again designated by 8, whereas the hydraulic drive means for swivelling the cutting arm 5 around the substantially vertical axis 9 is again designated by 12. By means of a 4/2-path-valve 17, which has not been drawn in detail, the pressure supplied by the pump 18 can selectively be supplied to the working chambers of cylinder-piston-aggregates 8 and 12, respectively. Controllably openable check-valves 20 are interconnected into the conduits 19 for pressurized fluid leading to the cylinder-piston-aggregate 8, noting that,if one of said both conduits is subjected to the pressure of the pressurized fluid, the check valve 20 interconnected into the other conduit and serving in this case as the return conduit is always simultaneously opened. Likewise, swivelling movement in horizontal direction around the substantially vertical axis 9 can be effected by means of the 4/2-path-valve 17 by pressurizing the cylinder-piston-aggregate 12. In addition to these usual valves for actuating said both drive means, there is now provided a control device which has as an essential element a stepped piston 21. Branch conduits 24 open via controllably openable check valves 23 into the pressure conduits 22 leading to the cylinder 12 of the horizontal swivel drive means and are connected with respective annular chambers 25 at both sides of the stepped piston 21. These annular chambers can now be subjected to the action of the pressure prevailing within the conduits 22 when opening the check valves 23. When swivelling the cutting arm in one direction, one of said both conduits 22 is effective as pressure conduit whereas the other conduit is made a return conduit. Pressurized fluid may enter one annular chamber 25 if the corresponding check valve 23 has been controlled to assume open position. The pressurized fluid can also be pressed into the respective centrally arranged working chamber 28 via the conduit 26 connected to the branch conduit 24 via a check valve 27 opening in direction to a centrally arranged working chamber 28 of the stepped piston 21. Simultaneously, the check valve 30 opening in direction to the working chamber 28 is steered open via a control conduit 29, noting that steering open is effected such that the respective check valve 30 of that working chamber is opened which is located opposite the pressurized side of the stepped piston. On account of the cross sectional surface becoming effective when pressurizing one annular chamber 25 and, in the following after steering open the check valve 27, also of the working chamber 28 located at the same side, the stepped piston 21 can be shifted in the just desired direction, noting that the shifting path is limited by stops 31 provided within the opposite centrally arranged working chamber. A predetermined volumetric amount of pressurized fluid is thus expelled from the respective opposite working chamber 28 and can be supplied to the other drive means, in the illustrated case to the cylinder-piston-aggregate 8, for lifting and lowering the cutting arm. In this connection, there is additionally provided a preselection means and a control slide piston, the control slide piston being schematically indicated by the reference numeral 32 and the associated preselection means being schematically indicated by the reference numeral 33. There is further provided a source 34 of control pressure, the pressure of which source can be distributed by the preselection means 33 such that the control slide piston 32 can be shifted in one of the shown both directions being indicated by the arrow 35. In dependence on the position of the control slide piston 32, any volumetric amount of pressurized fluid expelled from a central working chamber 28 becomes effective in the upper or in the lower working chamber of the cylinder-piston-aggregate 8 and a prechamber selection of the depth of cut in upward or in downward direction can be made in dependence on the selected volumetric amount. On account of expelling a volumetric amount from a centrally arranged working chamber 28 taking place simultaneously with swivelling the cutting arm in substantially horizontal direction by pressurizing the cylinder-piston-aggregate 12, there results as a whole a cutting operation in diagonal direction as long as pressurized fluid is expelled out of the centrally arranged working chamber 28. After having expelled this volumetric amount, preselection of the depth of cut is finished and usual cutting work can be continued by actuating the horizontal traversing gear or the cylinder-piston-aggregate 12, respectively.

The check valves 23 provided in the branch conduits 24 are, in the arrangement shown, equally actuated via a control conduit 36 in dependence on the position of the preselection means 33, so that diagonal cutting operation can be initiated by the preselection means 33. The container, to which open the return conduits, is designated by 37 in FIG. 3, noting that an additional container 38 for the pressurized fluid in the source of control pressure and the corresponding return conduit is schematically indicated.

Figure 4:
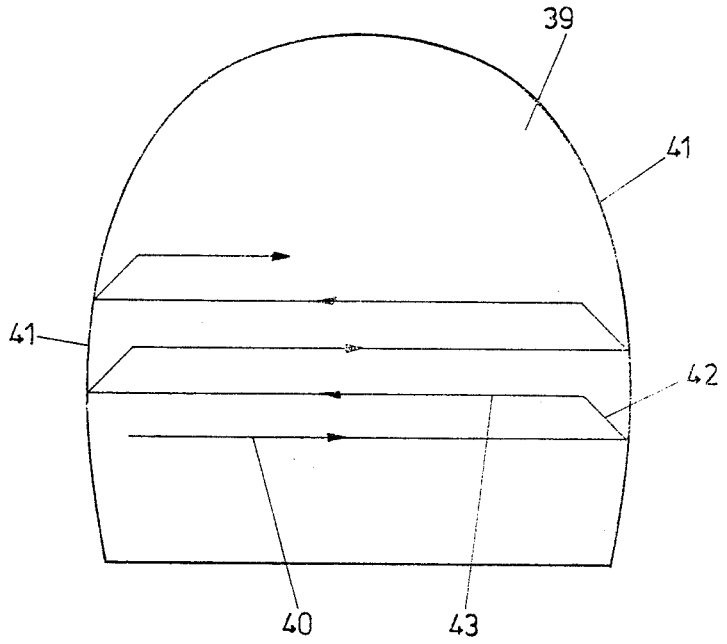

The path of movement of the cutting head along the drift face 39, which path can be obtained with a device described, is schematically shown in FIG. 4. Cutting operation is, for example, started by horizontal cutting along the line 40, noting that the cutting direction is reversed after having attained the nominal profile 41. By simultaneously actuating the horizontal traversing gear in opposite direction and the hydraulic cylinder-piston-aggregate 8 in the sense of a lifting movement, which can be preselected by adjusting the control slide piston 32, there results now,on occasion of a reversal of the direction of movement,a substantially diagonally extending partial path of movement which is designated by 42 in FIG. 4. After having finished the stroke or having finished the preselection of the depth of cut, cutting is effected in an essentially horizontal direction along the line 43 till the nominal profile at the opposite side is attained. On account of the diagonal partial path 42, there remains no rib between the cutting heads when preselecting a new depth of cut, and immediately subsequently cutting work in opposite direction can be continued without the risk of overloading the drive means. The operation can to a great extent be automated by means of a template control.

What is claimed is:

1. Apparatus for controlling the movement of a universally swivellable cutting arm comprising:

a first hydraulic drive means for lifting and lowering the cutting arm;

a second hydraulic drive means for swivelling the cutting arm transverse to the lifting and lowering direction;

means for actuating said first and second hydraulic drive means to advance the cutting arm along a predetermined path, said actuating means including means for introducing a predetermined volume of hydraulic fluid to said first hydraulic drive means simultaneously to introducing hydraulic fluid to said second hydraulic drive means, whereby the cutting arm may be driven along a first horizontal stroke, a short sloping stroke and at least a second horizontal stroke, the path of the second horizontal stroke being separated from the path of the first horizontal stroke by a predetermined vertical distance.

2. Apparatus according to claim 1, wherein said introducing means comprises a stepped piston which can be subjected to the action of pressurized fluid via a centrally arranged working chamber of a separate annular chamber, and a plurality of controllable valves for connecting said centrally arranged chamber to said first hydraulic drive means.

3. Apparatus as claimed in claim 2, characterized in that the stroke of the stepped piston can be adjusted.

4. Apparatus as claimed in claim 2, further comprising a source of control pressure, which source can be connected via a preselection means with a control slide piston for controlling the direction of movemnet of the first hydraulic drive means and which source can further be connected with controllably openable check valves provided in branch conduits of the supply conduit and a discharge conduit of the second hydraulic drive means of the cutting arm.

5. Apparatus as claimed in claim 4, characterized in that said branch conduits of the supply conduit and of the discharge conduit of the second hydraulic drive means are at times connected with said annular chambers at both sides of said stepped piston and in that conduits are branched off said annular chambers and are connected with said centrally arranged working chamber at the same side of said stepped piston via check valves.

6. Apparatus as claimed in claim 2 characterized in that there are provided controllably openable check valves opening in direction of said centrally arranged working chambers of the stepped piston, into conduits connecting said centrally arranged working chambers of the stepped piston via the control slide piston with working chambers of said first hydraulic drive means.

7. Apparatus as claimed in claim 6, characterized in that the control conduits for the check valves of a centrally arranged working chamber are connected with the branch conduit leading to the opposite annular chamber or centrally arranged working chamber, respectively.

8. Apparatus as claimed in claim 7, characterized in that the branch conduits connected to the annular chambers of the stepped piston are connected with the conduits leading to the second hydraulic drive means.

* * * * *